United States Patent [19]

Winn

[11] 4,058,082

[45] Nov. 15, 1977

[54] SUBMERSIBLE PAINTING APPARATUS

[75] Inventor: Russell Edward Winn, Kilbrittain, Ireland

[73] Assignee: A/S Jotungruppen, Sandefjord, Norway

[21] Appl. No.: 699,687

[22] Filed: June 25, 1976

[51] Int. Cl.[2] ..... B05C 1/00

[52] U.S. Cl. ..... 118/9; 118/207

[58] Field of Search ..... 118/207, 305, 9, 108, 118/111; 114/222; 15/1.7, 50 R, 87

[56] References Cited

U.S. PATENT DOCUMENTS

| | | | |
|---|---|---|---|
| 1,079,208 | 11/1913 | Browne | 114/222 |
| 1,927,225 | 9/1933 | Woods | 15/50 R |
| 2,104,062 | 1/1938 | Temple | 118/305 X |
| 3,121,895 | 2/1964 | Burgoon | 15/50 R |
| 3,147,143 | 9/1964 | Kontani et al. | 118/305 |
| 3,248,812 | 5/1966 | Gardner, Jr. | 15/1.7 X |
| 3,639,936 | 2/1972 | Ashton | 15/87 X |
| 3,859,948 | 1/1975 | Romano et al. | 15/1.7 X |

FOREIGN PATENT DOCUMENTS

| | | | |
|---|---|---|---|
| 137,426 | 4/1961 | U.S.S.R. | 118/207 |

*Primary Examiner*—John P. McIntosh

*Attorney, Agent, or Firm*—Browdy and Neimark

[57] ABSTRACT

The invention is concerned with an apparatus which can be used underwater for applying paint to a submerged surface, such as the hull of a ship, by remote control from the surface, hence obviating the use of divers and, in the case of ships' hulls, the necessity of placing the ship in dry-dock. The submersible painting apparatus comprises a remotely-controllable vehicle capable of being driven along, while adhering to, a submerged surface and a remotely-controllable painting means located at the rear of the vehicle capable of applying to a submerged surface paint formulated for application underwater. The submersible painting apparatus advantageously incorporates a device for surveying submerged structures, for example measuring the thickness of a ship's hull or detecting flaws or depressions in the hull of a vessel.

3 Claims, 4 Drawing Figures

SUBMERSIBLE PAINTING APPARATUS

This invention relates to a submersible painting apparatus and is concerned with an apparatus which can be used underwater for applying paint to a submerged surface, for example the hull of a ship, by remote control from the surface.

In order to apply an anti-corrosive or anti-fouling paint to a ship's hull in areas normally below the waterline, it has hitherto generally been necessary to place the ship in dry-dock. This is both expensive and time-consuming and entails the ship being out of use while the painting operation is being carried out, which means a considerable loss of revenue to the ship's owners particularly in the case of the large ships such as oil tankers now in use.

To mitigate the foregoing disadvantages, some marine paints for underwater application have become available within the last few years. However such paints have hitherto only been applied with the aid of divers who are required to operate underwater painting apparatus for applying said paints. The necessity to use divers limits the usefulness of such paints and underwater apparatus and reduces their cost effectiveness over normal dry-dock painting.

Hence there is a need for an apparatus by means of which marine paints can be applied underwater to a submerged surface without the necessity for using divers.

In accordance with the present invention, there is provided a submersible painting apparatus comprising a remotely-controllable vehicle capable of being driven along, whilst adhering to, a submerged surface and located at the rear of the vehicle remotely-controllable painting means capable of applying by brush means underwater paint to a submerged surface.

The remotely-controllable painting means is preferably detachably mounted on the remotely-controllable vehicle for ease of servicing and/or replacement.

The submersible painting apparatus can advantageously incorporate a device for surveying submerged structures.

The vehicle can comprise a housing defining a chamber having an open side, a pressure-reducing device capable of continuously maintaining a reduced pressure inside the chamber relative to the pressure outside the chamber, a steerable wheel mounted so that the vehicle can be driven along the submerged surface with the open side of the chamber facing the submerged surface, a steering device for steering the steerable wheel, and a motor for driving the vehicle. The vehicle is remotely operable from above the water surface, for example by way of a control cable connecting a work boat at the surface of the water and a junction box on the vehicle.

The steerable wheel of such a vehicle can be mounted within the chamber so that its running surface projects through the open surface of the chamber. The vehicle can also include two or more supporting wheels in addition to the steerable wheel.

The driving motor can drive the steerable wheel, the other supporting wheels, or all wheels provided in such a vehicle.

The driving motor can be an electric motor or can be a motor operated by a hydraulic medium under pressure.

The pressure reducing device can be a propeller pump having propeller blades located within an outlet duct provided in the chamber wall. The propeller pump can be an oil-cooled electric motor, and the cooling oil under pressure can be used as a hydraulic source of power for other pumps or motors in the apparatus.

The edge region of the housing which bounds the open side and which comes into close proximity with the submerged surface can be provided with a series of corrugations which, in use of the apparatus, establish turbulent conditions and reduce the ingress of water into the chamber; this means that less power is required to maintain a reduced pressure inside the chamber relative to the pressure outside the chamber. The corrugations may be discontinuous but are preferably continuous.

The vehicle can also include a device for sensing and indicating the attitude of the vehicle, as well as a device for sensing the position of the chamber relative to a submerged surface.

It is desirable that the apparatus of the present invention is either slightly buoyant or is of neutral buoyancy.

To assist in operating the apparatus of the present invention by remote control it is desirable to have a control console at the surface of the water. Advantageously the console can be positioned on a work boat floating near the submerged surface (for example, part of the hull of a vessel) on which the underwater painting operation is to be carried out. Alternatively the console may be mounted on a vessel the submerged surfaces of which are to be painted. The control console can include a paint pressure gauge, a tachometer which can be connected to any individual paint brush as desired, means for controlling the supply of paint to the applicators, means for controlling the movement of the brushes to an inoperative position, and means for controlling the movement and position of the apparatus on a submerged surface to be painted.

In practice, if the submerged surface is in need of cleaning, the cleaning is effected before the painting is carried out. Once the submerged surface is clean, the submerged surface can be painted using the apparatus of the present invention.

The remotely-controllable painting means mounted on the rear of the vehicle (with respect to the normal forward direction of movement) may comprise a plurality of rotatable brushes, means for rotating the brushes and means for feeding underwater paint to each of said brushes. The brushes have bristles which are preferably substantially parallel to the axis about which each brush is rotatable.

The painting means is preferably provided with means for ensuring that each brush can move in a direction substantially at right angles to the surface being painted and can maintain a substantially constant pressure on said surface. In addition the painting means is preferably provided with remotely-operable means for withdrawing the plurality of brushes from an operative to an inoperative position and, when desired, for allowing the brushes to return to the operative position under their own weight.

In order to enable a broad band of submerged surface to be painted during one movement of the apparatus, the plurality of rotatable brushes may be arranged in a manner such that during advancement of the apparatus, the areas covered by adjacent brushes overlap, thereby ensuring that the desired broad band of submerged surface is painted. Thus the brushes may be arranged, for example, in two parallel rows with the brushes staggered, so as to ensure the aforementioned overlap. In such an arrangement it is desirable that one row of brushes should rotate in a direction opposite to that of the other row, so as to reduce the tendency of the rotating brushes to cause the painting apparatus to creep sideways.

Paints capable of being applied under water are commercially available. If required, the application of a suitable underwater anti-fouling paint can be preceded by the application to the cleaned submerged surface of an underwater primer. The paint supply and the pump for feeding the paint to the brushes will generally be mounted on a work boat (as for the control console) or on the vessel being painted.

As previously mentioned, the apparatus of the invention may incorporate a device capable of carrying out underwater surveying operations. Generally the underwater surveying will not be carried out at the same time as the underwater painting because of the deleterious effect which the paint may have on sensitive parts of the conveying equipment. However simultaneous underwater painting and surveying may be possible provided the necessary precautions are taken. Different types of suitable underwater surveying instruments which can be incorpoated in the painting apparatus of the invention are commercially available. The surveying equipment can be capable of various surveying operations, for example measuring the thickness of the hull of a vessel or detecting flaws or depressions in the hull of a vessel. The nature of the surveying equipment will depend on the nature of the survey work to be carried out.

For a better understanding of the invention and to show how the same may be carried into effect a preferred embodiment of the submersible painting apparatus of the invention will now be described in greater detail by reference to the accompanying drawings in which.

Figure 1:
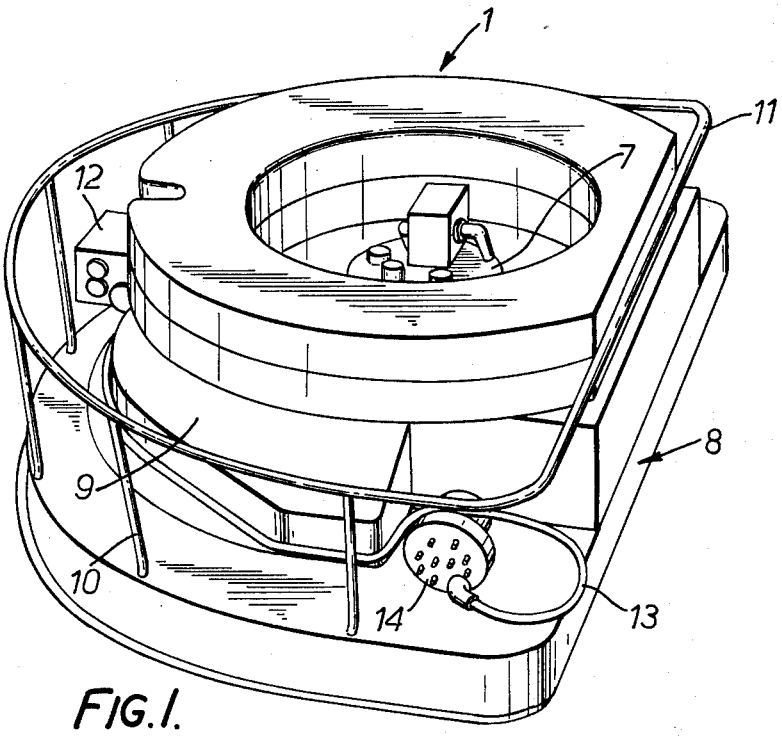
FIG. 1 is a perspective view from the port side of a remotely-controllable vehicle for a submersible painting apparatus.
Figure 2:
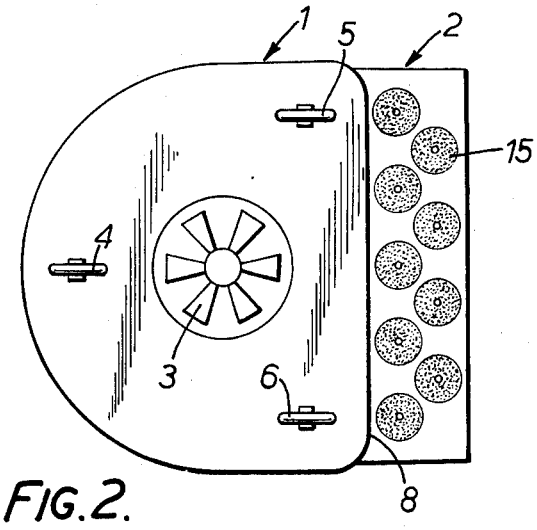
FIG. 2 is an underside plan view of the complete submersible painting apparatus having remotely-controllable painting means fastened to the vehicle.

Referring to FIGS. 1 and 2 of the drawings, the submersible painting apparatus is constituted by a vehicle 1 and painting means 2 fastened to the rear of the vehicle 1. The vehicle is provided with an impeller 3 driven by an electrically-powered motor 7 which is capable of rotating the impeller 3 in a manner such that, when the vehicle is submerged, water is expelled from a chamber defined by a housing of the vehicle to a region below the plane of the paper. The vehicle 1 is provided with a remotely-operable steerable wheel 4 and two support wheels 5 and 6. All three wheels are driven by independent hydraulic motors.

As can be seen from FIGS. 1 and 2, the vehicle 1 has an outline generally resembling a "D" with the straight edge of the "D" constituting the rear (or stern) of the vehicle as indicated by the reference numeral 8. The vehicle includes a housing 9 which is generally hollow apart from the various mechanical components accommodated therein. The housing 9 is provided with a plurality of stanchions 10 which support a rail 11 on to which ropes for securing the apparatus can be made fast.

When in use the painting apparatus is normally remotely controlled at the water surface from a work boat in which is mounted a control console, a supply of paint and a motor for feeding the paint to the paint brushes of the apparatus. This motor can be an electric positive displacement pump. The control console is attached to the painting apparatus by means of a multilead cable which is attached to the junction box 12 which in turn is connected by a further cable 13 to an electrical junction box 14 through which is fed power to operate means for withdrawing the paint brushes 15 from an operative to an inoperative position and to operate the tachometer provided on the control console for each of the paint brushes.

Figure 3:
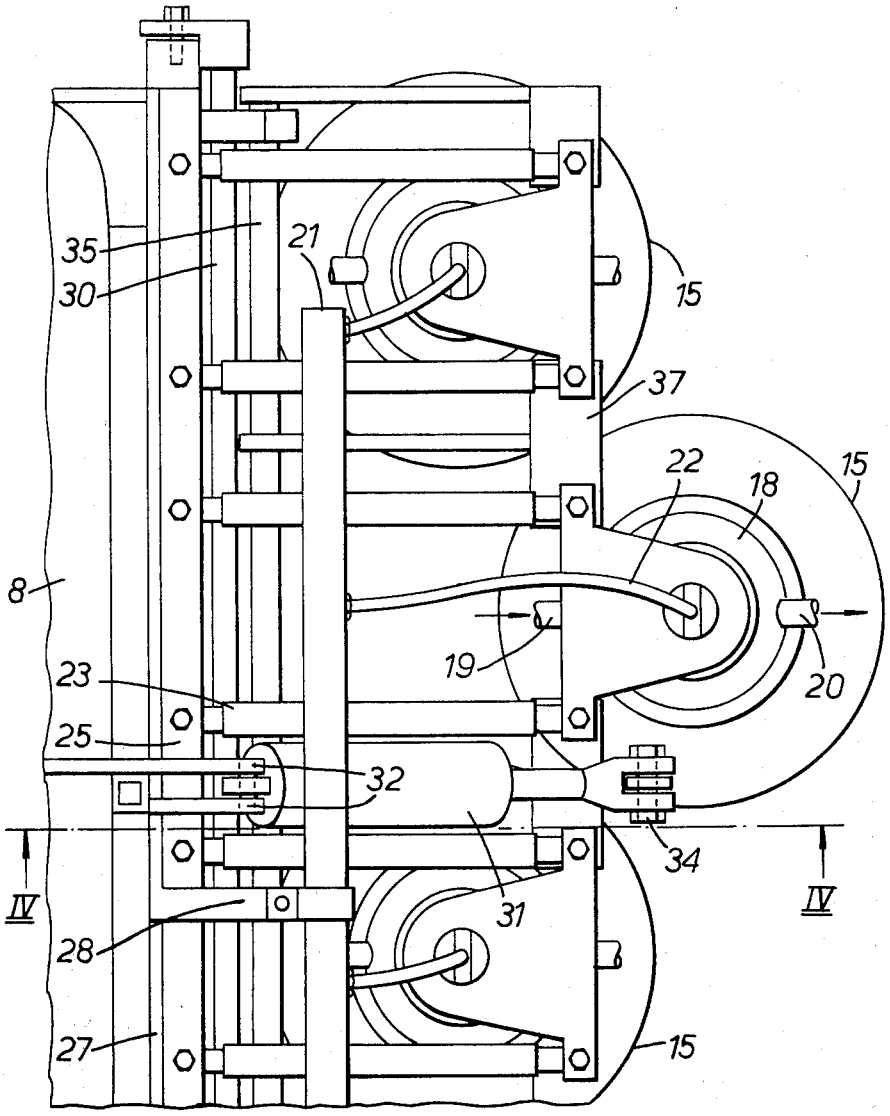
FIG. 3 is a top plan view on an enlarged scale of part of the painting means.
Figure 4:
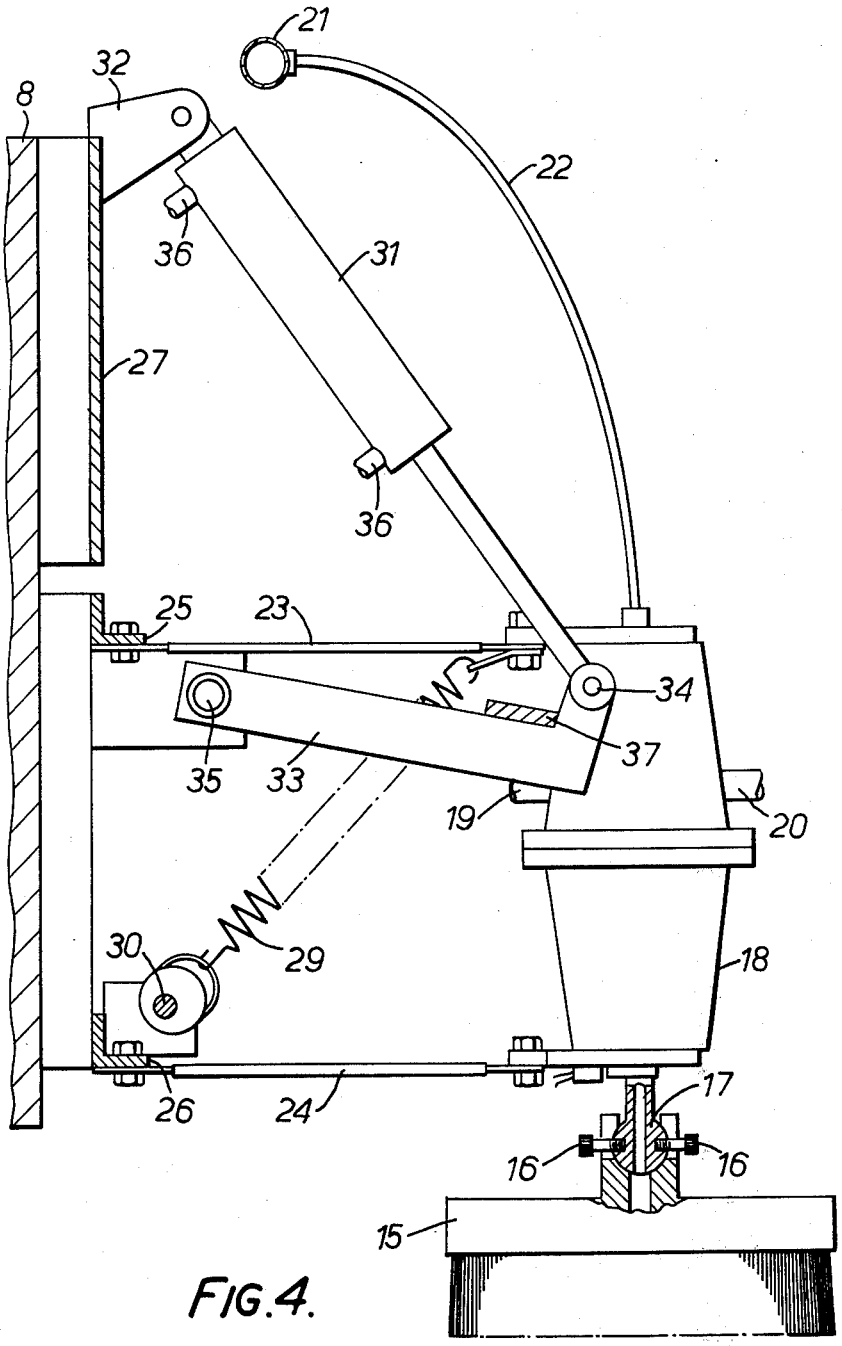
FIG. 4 is a vertical cross-section along the line IV—IV of FIG. 3.

Referring now to FIGS. 3 and 4 of the accompanying drawings, the painting means for the submersible painting apparatus is provided with nine rotatable brushes 15 which are arranged in two rows, one of five brushes and one of four brushes, with the brushes being staggered as can be seen in FIG. 2. The brushes can be made of bristle, nylon or horsehair. Each brush 15 is secured by bolts 16 to a universal joint 17 which is driven by an hydraulic motor 18 operated by hydraulic fluid which enters by supply pipe 10 and leaves by return pipe 20. Underwater paint can be fed to the brush 15 from a paint manifold 21 through a flexible feed pipe 22 which communicates with the brush 15 through a hollow shaft in the motor 18. Each hydraulic motor 18 is retained in position by two pairs of leaf springs each pair comprising an upper leaf spring 23 and a lower leaf spring 24 fastened respectively to an upper foundation plate 25 and a lower foundation plate 26 both of which are in turn mounted on a steel backplate 27 attached to the vehicle rear 8. Also attached to the backplate 27 are supporting arms 28 for the paint manifold 21. A coil spring 29 extends between the end of the leaf spring 23 which is adjacent to the motor 18 and an eccentric shaft 30. This spring arrangement serves to maintain substantially constant the pressure of the brushes 15 on the surface being painted.

An hydraulically-operated ram 31 (one of a pair the second not being shown in the drawings) is secured at one end to the backplate 27 by a bracket 32 and at its other end to a lever 33 by a hinged bolt 34. The lever 33 is rotatable about a shaft 35. The supply of hydraulic fluid to the ram 31 by the pipes 36 is controlled by a solenoid valve (not shown) the electrical power for which is supplied via the junction box 14 (see FIG. 1). When operated the solenoid valve can allow hydraulic fluid to flow through the ram 31 in either direction, so as to cause the lever 33 and hence the transverse bar 37 to travel either in an upwards or downwards direction, either withdrawing the brushes 15 from an operative to an inoperative position or vice versa.

If desired to assist the flotation of the submersible painting apparatus, a buoyancy bar (not shown) can be attached so as to be positioned astern of the paint brushes. The buoyancy bar can be made of glass fibre reinforced polyester resin.

I claim:

1. A remotely-controllable submersible apparatus for applying paint underwater to a submerged surface, the apparatus comprising a vehicle having a housing defining a chamber having an open side, a pressure-reducing device capable of continuously maintaining a reduced pressure inside the chamber relative to the pressure outside the chamber so as to cause the vehicle to adhere to the submerged surface with the open side of the chamber facing the submerged surface, a steerable driven wheel and at least one supporting wheel mounted so that the vehicle can be driven along the submerged surface with the open side of the chamber adjacent to the submerged surface, a remotely-operable steering device for steering the steerable wheel, a motor for driving at least the steerable wheel, and located at the rear of said vehicle an assembly for applying paint underwater to the submerged surface, the assembly comprising in combination a plurality of non-intermeshing vertically disposed rotary paint brushes each having an axial bore communicating with a feed pipe from a paint manifold, a separate hydraulic motor for independently driving each respective rotary pant brush, resilient suspension means for each hydraulic motor and its associated brush including an upper leaf spring means and a lower leaf spring means, a spring tensioning means connected to one end to said upper leaf spring means and at its other end to a manually adjustable eccentric cam shaft, and remotely-operable hydraulic means for moving the rotary paint brushes either into contact with or away from the submerged surface.

2. An apparatus as claimed in claim 1, wherein the plurality of independently driven rotary paint brushes are arranged in two rows substantially perpendicular to the normal forward direction of movement of the vehicle, with the brushes being located in staggered relationship laterally with respect to said direction of movement, and wherein one row of brushes is arranged to rotate in a direction opposite to that of the other row.

3. An apparatus as claimed in claim 1, including an underwater surveying device capable of measuring the thickness of the hull of a vessel or of detecting flaws and depressions in the hull of a vessel.

* * * * *